US008117682B1

(12) United States Patent
Bowden

(10) Patent No.: US 8,117,682 B1
(45) Date of Patent: Feb. 21, 2012

(54) TOILET CLEANING DEVICE

(76) Inventor: Andrew Scott Bowden, Stockholm, NJ (US)

( * ) Notice: Subject to any disclaimer, the term of this patent is extended or adjusted under 35 U.S.C. 154(b) by 1085 days.

(21) Appl. No.: 11/924,745

(22) Filed: Oct. 26, 2007

Related U.S. Application Data

(60) Provisional application No. 60/854,149, filed on Oct. 26, 2006.

(51) Int. Cl.
*E03D 9/02* (2006.01)

(52) U.S. Cl. ..... 4/223

(58) Field of Classification Search ..... 4/661, 420.4, 4/420.5, 443, 447, 448, 903; 239/110, 106; 134/198, 93, 100.1
See application file for complete search history.

(56) References Cited

U.S. PATENT DOCUMENTS

| | | | | |
|---|---|---|---|---|
| 2,646,059 | A * | 7/1953 | Wittner et al. | 137/217 |
| 2,950,061 | A * | 8/1960 | Dickinson | 239/110 |
| 3,042,312 | A * | 7/1962 | Packard | 239/315 |
| 3,863,843 | A * | 2/1975 | Hechler, IV | 239/318 |
| 4,287,618 | A * | 9/1981 | Silver | 4/443 |
| 4,852,201 | A | 8/1989 | Wundrock et al. | |
| D343,447 | S * | 1/1994 | Thaler et al. | D23/295 |
| 5,360,172 | A * | 11/1994 | Wang | 239/586 |
| 5,503,633 | A * | 4/1996 | Saunders et al. | 604/332 |
| 5,685,028 | A * | 11/1997 | Miller et al. | 4/443 |
| 5,720,055 | A | 2/1998 | Krist | |
| 5,937,451 | A * | 8/1999 | Mihara | 4/448 |
| 6,076,199 | A | 6/2000 | Na | |
| 6,357,057 | B1 * | 3/2002 | Krist | 4/420.4 |
| 6,453,489 | B1 * | 9/2002 | Lee et al. | 4/675 |
| 6,675,400 | B1 * | 1/2004 | Chang Chien | 4/443 |
| 6,704,946 | B1 | 3/2004 | Mueller et al. | |
| 6,941,590 | B2 * | 9/2005 | Lim | 4/420.4 |
| 6,968,580 | B1 * | 11/2005 | Chang Chien | 4/420.4 |
| 6,973,679 | B1 * | 12/2005 | Schad | 4/420.4 |
| 6,978,492 | B1 * | 12/2005 | Francisco et al. | 4/420.4 |
| 7,073,209 | B1 | 7/2006 | McCormick | |
| 7,155,754 | B2 * | 1/2007 | Chung | 4/443 |
| 7,427,037 | B2 * | 9/2008 | Frazee | 239/109 |
| 7,461,414 | B2 * | 12/2008 | Santa Cruz et al. | 4/420.4 |

* cited by examiner

*Primary Examiner* — Gregory Huson
*Assistant Examiner* — Janie Christiansen
(74) *Attorney, Agent, or Firm* — Thomas L. Adams

(57) ABSTRACT

A toilet cleaning device employs a handheld dispensing device having an internal barrier with a channel and an orifice. Water passing through the dispensing device is compelled to flow through the orifice in the barrier. An external trigger located at the handle section of the dispensing device is coupled to a shuttle which can slide in a channel and control water flowing through the orifice. A cleaning agent in the form of solid, water soluble pellets is loaded in a cavity in a barrel section of the dispensing device and then contained by attaching a nosepiece to the barrel. An elongated outlet tube cantilevered from the nosepiece has a proximal section and an obliquely angled distal section and can dispense all water flowing therethrough in a single concentrated stream into a toilet. A hose can connect the dispensing device to a supply line for a toilet. A holster mounted at the toilet can hold the dispensing device.

20 Claims, 2 Drawing Sheets

TOILET CLEANING DEVICE

CROSS-REFERENCES TO RELATED APPLICATIONS

This application claims the benefit of U.S. Provisional Patent Application Ser. No. 60/854,149, filed Oct. 26, 2006, the contents of which are hereby incorporated by reference herein.

BACKGROUND OF THE INVENTION

1. Field of the Invention

The present invention relates to cleaning devices and, in particular, to dispensers that convey water into a toilet.

2. Description of Related Art

The bathroom is one of the most used rooms in any household. People use the bathroom to shower or bathe, brush their teeth and undergo other personal grooming tasks. In addition, the most necessary of items, the toilet, is mounted in the bathroom. Because all human beings have the need to use the toilet, a toilet in an average household withstands a considerable amount of use each day. Since the bathroom is used to maintain personal hygiene, it is important that the bathroom, and everything in it, be kept sanitary. However, cleaning the bathroom is a loathsome task for many.

One aspect of keeping the bathroom sanitary is maintaining a clean toilet bowl. Commonly, a cleanser is applied to the inside of the toilet bowl and a brush is used to scrub waste off of the bowl. After loosening the waste with the toilet brush, the toilet is flushed to rinse away the waste and the cleanser. A number of problems arise from using this method.

First, once the toilet brush is used it becomes quite unsanitary. Simply rinsing the brush to remove visible waste does not disinfect it. If a user must take the time to disinfect the toilet brush, the amount of work required to completely disinfect the toilet is greatly increased. Further, storing the toilet brush is unsightly and takes up valuable space in the bathroom.

Another problem with this common cleaning method is that the cleanser is completely rinsed away when the toilet is flushed. On the other hand, all of the waste inside the toilet bowl may not be expunged with the first flush. The user must wait for the toilet to refill, and then repeat the entire process. This repetition wastes valuable time, expensive cleanser, and precious water.

See also U.S. Pat. Nos. 4,852,201; 5,720,055; 6,076,199; 6,704,946; and 7,073,209.

SUMMARY OF THE INVENTION

In accordance with the illustrative embodiments demonstrating features and advantages of the present invention, there is provided a toilet cleaning device including a hose and a handheld dispensing device with a manually operable valve. The hose is hose distally connected to the dispensing device and adapted to be proximally connected to a supply line for a toilet in order to supply water to the dispensing device. The dispensing device is operable to dispense water in a concentrated stream into the toilet.

In accordance with another aspect of the invention a toilet cleaning device is provided. The toilet cleaning device includes a handheld dispensing device with a manually operable valve. Also included is a hose distally connected to the dispensing device and adapted to be proximally connected to a supply line for a toilet in order to supply water to the dispensing device. The toilet cleaning device also includes a cleaning agent loaded into the dispensing device for progressive dissolution into water passing through the dispensing device.

In accordance with yet another aspect of the invention a toilet cleaning device is provided. The toilet cleaning device includes a handheld dispensing device having a handle section and a barrel section with a barrel cavity. The dispensing device has an internal barrier with a channel and an orifice. The barrier is arranged to compel water passing through the dispensing device to flow through the orifice in the barrier. The dispensing device includes a manually operable valve, a cleaning agent, a nosepiece, and an elongated tube. The manually operable valve has an external trigger and a shuttle that is coupled to the trigger and slidably mounted in the channel to control water flow through the orifice. The cleaning agent is in the form of a plurality of solid, water soluble pellets that are loaded in the barrel cavity. The nosepiece is removably attached to the barrel to contain the cleaning agent. The elongated outlet tube is cantilevered from the nosepiece. The outlet tube has a proximal section and a distal section disposed at an oblique angle from the proximal section. The outlet tube is arranged to dispense all water flowing therethrough in a single concentrated stream into the toilet. The cleaning device includes a hose distally connected to the dispensing device and adapted to be proximally connected to a supply line for a toilet in order to supply water to the dispensing device. The cleaning device includes a holster for holding the dispensing device. The holster is adapted for mounting at the toilet.

By employing apparatus of the foregoing type an improved toilet cleaning device is achieved. In one embodiment a T-fitting between a toilet tank and shut off valve supplies water through a hose to a handheld device. In this embodiment the handheld device has a handle section with a valve that is manually operated by an external trigger. The handle section communicates to an integral right angle elbow that supplies water to a barrel section. The barrel section has a cavity with grates at either end for holding a replenishable cleaning agent, e.g., solid pellets with a disinfecting action.

In one embodiment the valve in the handle section has a trigger-operated shuttle that slides in a channel. The channel has an upstream and downstream orifices. When the shuttle trigger is depressed it moves the shuttle away from the orifices allowing water to flow through the handle into the barrel section to dissolve some of the cleaning agent, which may then be dispensed into a toilet bowl.

In this embodiment the outlet of the handheld device is a tube that is bent at an angle to allow the discharged water stream to reach various regions of the bowl, including regions under the rim of the bowl.

When no longer in use, the handheld device can be stored in a holster that may be attached to the side of the toilet tank.

BRIEF DESCRIPTION OF THE DRAWINGS

The above brief description as well as other objects, features and advantages of the present invention will be more fully appreciated by reference to the following detailed description of illustrative embodiments in accordance with the present invention when taken in conjunction with the accompanying drawings, wherein.

DETAILED DESCRIPTION OF THE PREFERRED EMBODIMENTS

Figure 1:
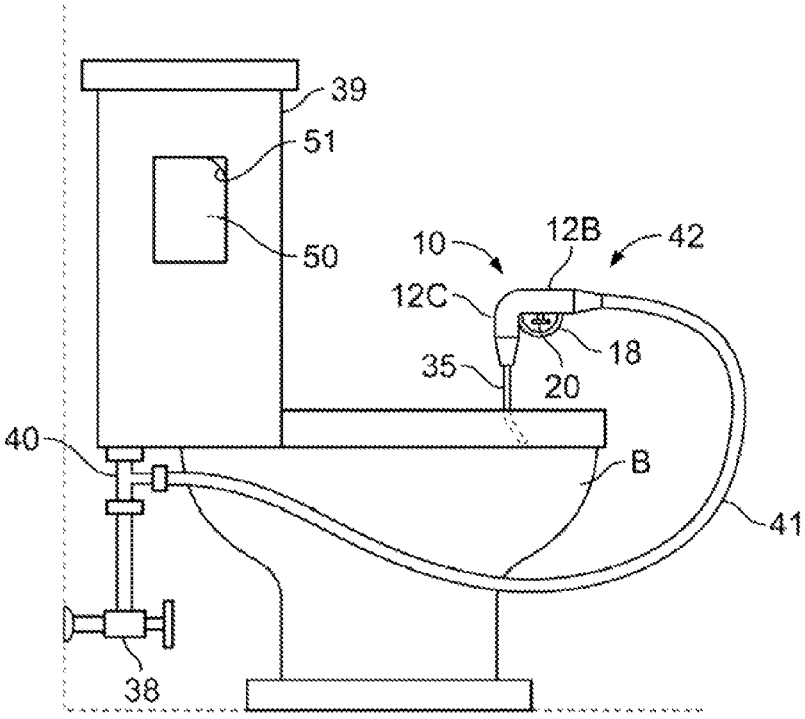
FIG. 1 is a cross-sectional view of for a toilet cleaning device in accordance with principles of the present invention.
Figure 2:
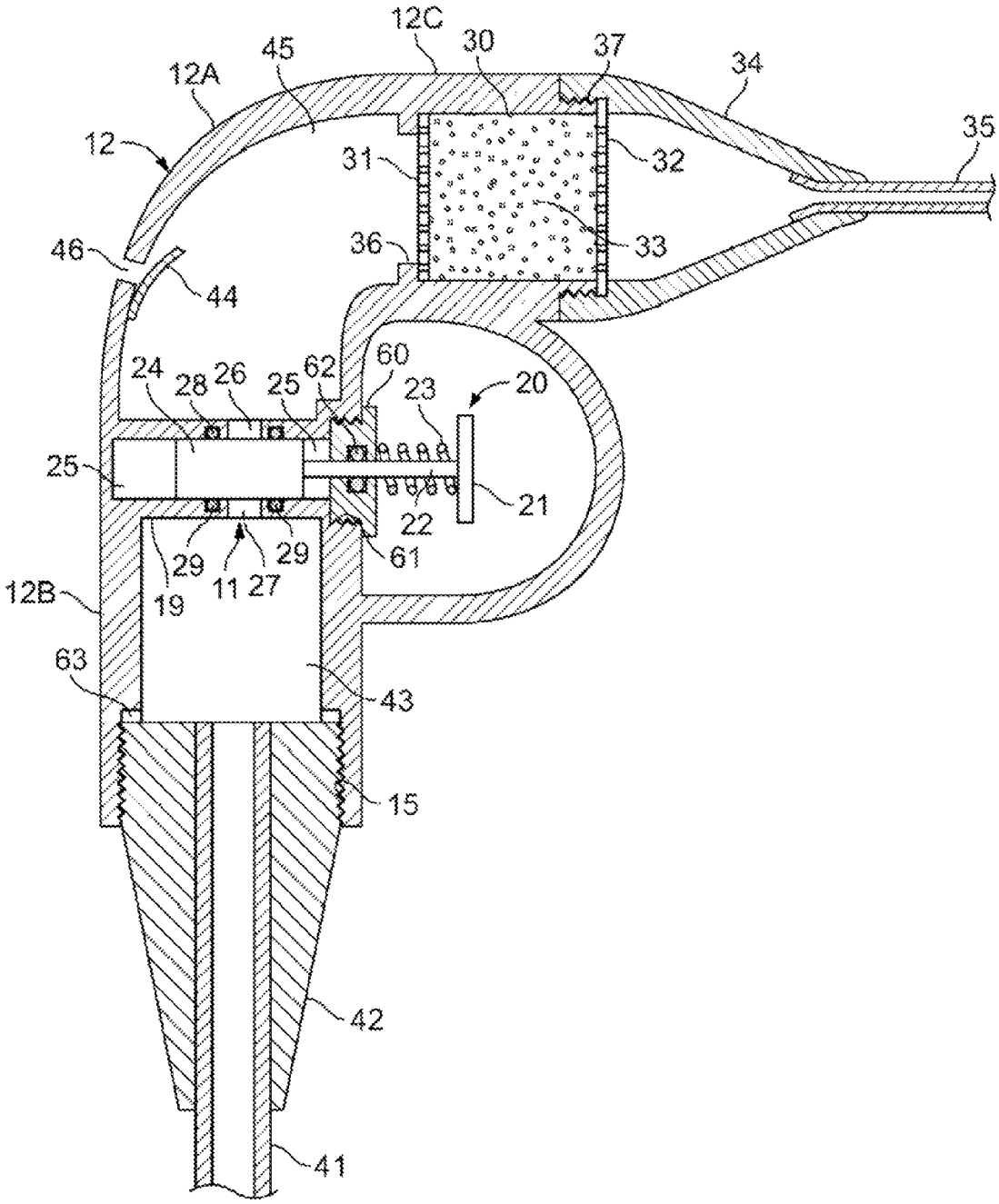
FIG. 2 is a cross-sectional view of the handheld dispensing device of FIG. 1 with portions broken away for illustrative purposes.

Referring to FIGS. 1 and 2, a handheld dispensing device 10 includes a hollow structure 12 having a 90° elbow 12A joining a handle section 12B and a barrel section 12C. Sections 12B and 12C may be cylindrical, although other embodiments may have cross-sections that are rectangular, polygonal, oval, etc. The hollow structure 12 may be fabricated from a durable plastic, metal, or other non-corrosive material. In some embodiments structure 12 may be formed of two halves that are welded along a plane containing the axes of sections 12B and 12C. The elbow 12A and handle section 12B encompass cavities 45 and 43, respectively. Cavity 45 has a vent hole 46 that is open unless cavity 45 is pressurized in which case internal check flap 44 is driven against vent hole 46 to close it.

Manually operable valve 11 is located between cavities 43 and 45 in transverse internal barrier 19. Barrier 19 is a wall that would prevent communication between cavities 43 and 45 except that orifices 26 and 27 communicate with a transverse channel 25 in the shape of a blind bore whose cross-section may have a rectangular or other shape. The barrier 19 may be integrally formed in structure 12, although in some embodiments the barrier may be a separate disc.

Slidably mounted inside channel 25 is shuttle 24, which in this embodiment is a rectangular bar closely fitting the inside of channel 25. Shuttle 24 is shown in a closed position overlapping orifices 26 and 27 to prevent flow between them. The inside ends of orifices 26 and 27 are sealed to shuttle 24 by O-rings 28 and 29, which are mounted in circular grooves that encircle the orifices. Shuttle 24 is just slightly more than half the length of channel 25, allowing room for the shuttle 24 to slide left (in this view) to the inside (deep) end of channel 25 to uncover orifices 26 and 27.

The shuttle 24 is coupled to an external trigger 20 via axial extension rod 22 whose distal end terminates in finger-pad 21. Shuttle 24 is held in place by externally threaded collet 60, which is screwed into a threaded bore 61 at the open end of channel 25. Mounted in an interior annular groove in collet 60 is O-ring 62, which surrounds and seals to extension rod 22, allowing the extension rod 22 to reciprocate in collet 60 without leaking.

Helical compression spring 23 encompasses the external portion of the extension rod 22 between finger-pad 21 and collet 60. When the trigger 20 is depressed, shuttle 24 slides towards the closed end of channel 25, uncovering both orifices 26 and 27. A finger-guard 18 spanning handle section 12B and barrel section 12C encompasses trigger 20 to avoid accidental operation thereof.

An elongated piece of flexible tubing 41 measures several feet in length, and may be made of plastic or rubber material or may be flexible braided metal around a rubber-like hose. The distal end of flexible tubing 41 is secured to a tapered fitting 42 by an adhesive. Alternatively, tubing 41 may be secured by a compression fitting or other means. The illustrated external threads on fitting 42 are screwed into the internal threads 15 at the outer end of section 12B. A washer-like gasket 63, made of a plastic, rubber, silicone, or the like, is compressed between fitting 42 and handle section 12B.

The proximal end of flexible tubing 41 may terminate in a metal collar that is crimped in place and then connected to one branch of tee-fitting 40 by a compression fitting or other means. The other two branches of tee-fitting 40 connect directly to toilet tank 39 and to a pipe connected to shut-off valve 38, the latter supplying household water from a supply line in the usual fashion. Accordingly, water supplied through shut-off valve 38 can flow through tee-fitting 40 not only to toilet tank 39 but through flexible tubing 41 to cavity 43 of dispensing device 10.

Tapered nosepiece 34 has on its proximal end internal threads that screw onto external threads 37 at the distal end of barrel section 12C. When nosepiece 34 is screwed on, perforated grate 32 is compressed along its edge between nosepiece 34 and the distal end of barrel section 12C to act as a gasket between them. Perforated grate 31 abuts the distal face of annular ridge 36 inside barrel section 12C.

Captured in the space between grates 31 and 32 is cleaning agent 33. Cleaning agent 33 may be solid pellets with disinfecting action, such as a mixture of an alkali carbonate, an acid, and one or more surfactants. Other suitable materials include, for example, hypochlorite salts, chloramines, chlorimines, chloramides, chlorimides, perborates, cyanuric acids, and hydantoins together with stabilizing salts and surfactants. The perforations in grates 31 and 32 are small enough to prevent passage of the pellets of agent 33. Alternatively, cleaning agent 33 may be contained in a porous bag (not shown) with pores smaller than perforations in grates 31 and 32.

Figure 3:
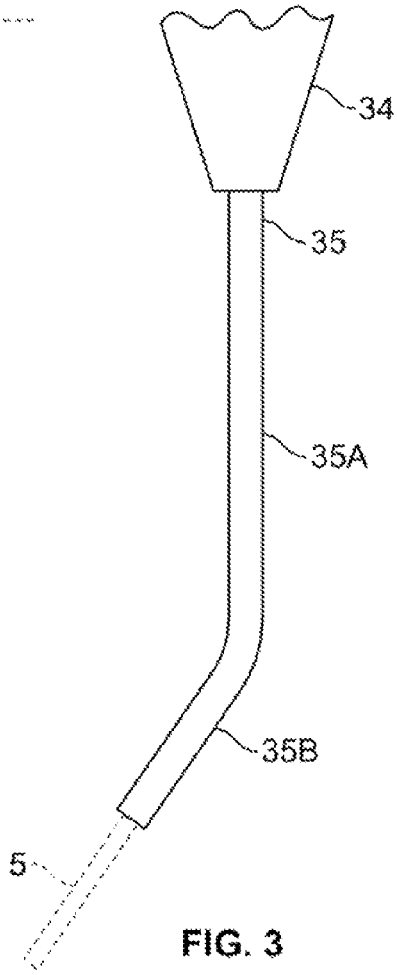
FIG. 3 is a fragmentary, detailed side view of the nosepiece and outlet tube of the handheld dispensing device of FIG. 1.

As shown in FIGS. 2 and 3, the distal end of the nosepiece 34 is tapered and encircles a cantilevered, elongated outlet tube 35. This tube 35 may be made of metal or other non-corrosive material. The inside end of tube 35 extends into the nosepiece 34 and flares outward along the interior walls of nosepiece 34. The tube 35 is joined to the interior walls by an appropriate adhesive to prevent leakage.

In the preferred embodiment, outlet tube 35 is approximately four inches (10 cm) long. However, tube 35 can be made shorter or longer if desired. The outlet tube 35 extends for approximately 3 inches (7.6 cm) from nosepiece 34 along proximal section 35A before bending at a 30° angle from a straight line (i.e., the angle between section 35A and 35B is the oblique angle of 150°). The outlet tube 35 extends about one inch (2.5 cm) further after this bend along distal section 35B. It should be understood that the fixed angle may be greater or less than 30° and may bend in a different direction. Alternatively, the angled section 35B of the outlet tube 35 may be made with a flexible material which allows the user to adjust the desired angle.

Figure 4:
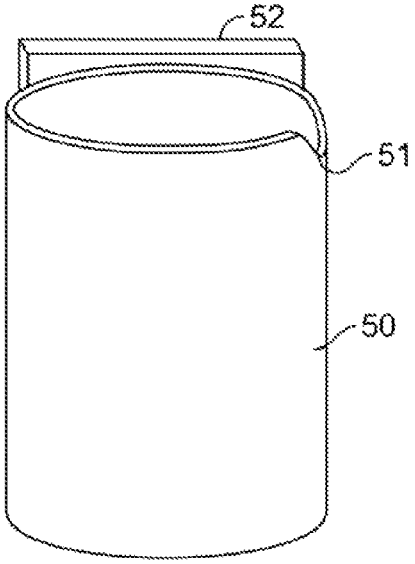
FIG. 4 is a perspective view of the holster shown in FIG. 1.

A holster shown in FIGS. 1 and 4 has a cylindrical cup 50 that provides a storage space for holding dispensing device 10. Cup 50 is fixed to a plate 52 that can be adhesively secured to the side of the toilet tank 39 by, for example, a foam with adhesive on both sides.

The rim of holster 50 includes a curved notch 51 that receives barrel section 12C to properly orient dispensing device 10 and prevent it from falling out. As previously mentioned, finger guard 18 is included in the dispensing device 10. The finger guard 18 prevents trigger 20 from being operated accidentally while resting in the holster 50. It should be understood that the holster 50 may be made in a variety of shapes. For example, it could be of a conical shape with a deeper notch to orient device 10 more strictly.

To facilitate an understanding of the principles associated with the foregoing apparatus, its operation will be briefly described. A user grasps the handle section 12B of the dispensing device 10 and inserts an index finger inside guard 18 to rest against finger-pad 21. By depressing pad 21 extension rod 22 slides the shuttle 24 toward the closed end of channel 25. Eventually shuttle 24 clears orifices 26 and 27 and O-rings 28 and 29. Then water under pressure in tubing 41 will flow through chamber 43, orifice 27, channel 25 and orifice 26 into cavity 45.

Water under pressure in cavity 45 forces check valve 44 into its closed position over vent hole 46. Water then flows through perforated grate 31 and into barrel cavity 30. Here, the water dissolves some of the cleaning agent 33 before flowing through the downstream grate 32. Water with cleaning agent then flows into the nosepiece 34 and through the outlet tube 35.

A single, concentrated stream S flows out from the outlet tube 35 to clean the desired area inside toilet bowl B. In one embodiment the water discharges from tube 35 at the rate of 3 liters per minute from tube 35 whose inside diameter is 0.25 inch (6.3 mm). It will be appreciated that the higher the flow rate and the narrower the tube, the more intense will be the discharging water pressure. An intense jet of water can be useful for quickly dislodging material that would not be easily removed by normal flushing. While the more intense water jet may be desirable for quick cleaning, a less intense stream may be preferred in some cases to avoid splashing. For most embodiments, the water flow rate will be between 0.5 to 10 liters per minute and a stream that is initially 1 to 12 mm in diameter.

In this process, the cleaning agent and water pressure easily remove any waste matter stuck to the interior surface of the toilet bowl B, sending it downward toward the toilet drain. The angled tubing 35 facilitates cleaning under the rim of bowl B.

When the user releases the trigger 20, spring 23 pushes finger-pad 21 and extension rod 22 outwardly to return shuttle 24 to its neutral position where it seals orifices 26 and 26 (with the assistance of O-rings 28 and 29). With the seals re-engaged, water is unable to flow past barrier 19.

The check valve 44 then returns to its open position, opening vent hole 46 to allow water to drain through tubing 35 away from cleaning agent 33 in barrel 30. With water thus drained, cleaning pellets 33 will not dissolve prematurely. Also check valve 44 prevents any backwash into the potable water. Handheld dispensing device 10 can then be safely stored in its holster 50.

In some cases the device 10 will be used after each use of the toilet just before or after normal flushing. In some cases device 10 will be used on a schedule as part of regular household cleaning. For example, the device can be used at this time as well as a conventional brush and toilet cleaner. Handheld dispensing device 10 eliminates the need to repeatedly flush the toilet, thereby saving water, time and money.

When it is time to replenish the cleaning pellets 33, the nosepiece 34 can be manually unscrewed from the dispensing device 10 and downstream grate 32 removed to expose barrel cavity 30 and thereby allow reloading of cleaning pellets.

It is appreciated that various modification may be implemented with respect to the above described embodiments. Water can be supplied to the handheld device from a separate water pipe or from a connection originating from inside the toilet tank. The water can be discharged from the handheld device through a nozzle having one or more orifices. In some embodiments, the water can be discharged in a stream, but in other cases the water may be discharged as a shower, a spray, a fan-like discharge, etc. The illustrated check valve can be located at various positions downstream of the valve. Instead of a trigger valve, the valve may be operated by a lever on the opposite side of the handle section. Also, various types of valves may be employed such as ballcock valves, poppet valves, valves with rotatable barrels with channels for regulating water flow, etc. The valve can be designed to finely adjust the water flow rate or can be a simple on/off valve. In addition, the size and shape of the handheld device can be altered depending upon the desired strength, capacity, durability, aesthetic considerations, etc. In some embodiments the holster may be a C-shaped clip, a ring or a container having a variety of shapes adapted to complement the handheld device.

Obviously, many modification and variations of the present invention are possible in light of the above teachings. It is therefore to be understood that within the scope of the appended claims, the invention may be practiced otherwise than as specifically described.

The invention claimed is:

1. A toilet cleaning device comprising:

a handheld dispensing device having a manually operable valve and a longitudinally extending handle section, said dispensing device having an outlet tube with a proximal section and a distal section, said outlet tube being sized and oriented to reach under the rim of a toilet bowl, said distal section being oriented to eject water at an acute angle relative to said handle in order to accomplish turning of water downstream of said handle by more than 90°, said dispensing device having a vent hole downstream of said manually operable valve;

a normally open check valve mounted at said vent hole for opening upon closure of said manually operable valve in order to vent said outlet tube and permit water to drain from said outlet tube; and a hose distally connected to said dispensing device and adapted to be proximally connected to a supply line for a toilet in order to supply water to said dispensing device, said dispensing device being operable to dispense water in a concentrated stream into said toilet.

2. A toilet cleaning device according to claim 1 wherein said outlet tube is operable to dispense all water flowing therethrough in a single concentrated stream, said distal section being disposed at an oblique angle from said proximal section.

3. A toilet cleaning device according to claim 2 wherein said dispensing device comprises:

a barrel section extending transversely from said handle section.

4. A toilet cleaning device according to claim 1 comprising:

a cleaning agent loaded into said dispensing device for progressive dissolution into water passing through said dispensing device.

5. A toilet cleaning device according to claim 4 wherein said dispensing device comprises:

a barrel section having a barrel cavity adapted to hold said cleaning agent; and a nosepiece removably attached to said barrel section to contain said cleaning agent.

6. A toilet cleaning device according to claim 5 wherein said outlet tube is cantilevered, elongated and supported by said barrel section, said distal section disposed at an oblique angle from said proximal section, said outlet tube being adapted to dispense all water flowing therethrough in a single concentrated stream.

7. A toilet cleaning device according to claim 1 wherein said manually operable valve has an external trigger.

8. A toilet cleaning device according to claim 7 wherein said dispensing device has an internal barrier with an orifice, said barrier being arranged to compel water flowing through said dispensing device to pass through said orifice in said barrier, said manually operable valve comprising:

a shuttle slidably mounted against said barrier to control water flow through said orifice.

9. A toilet cleaning device according to claim 8 wherein said barrier has a channel for slidably holding said shuttle.

10. A toilet cleaning device according to claim 7 comprising:

a cleaning agent loaded into said dispensing device for progressive dissolution into water passing through said dispensing device.

11. A toilet cleaning device according to claim 10 comprising:

a holster for holding said dispensing device, said holster being adapted for mounting at said toilet.

12. A toilet cleaning device according to claim 11 wherein said dispensing device comprises:

a barrel section for holding said cleaning agent, said trigger being positioned alongside said handle section.

13. A toilet cleaning device according to claim 1 comprising:

a holster for holding said dispensing device, said holster being adapted for mounting at said toilet.

14. A toilet cleaning device comprising:

a handheld dispensing device having an outlet tube, a manually operable valve and a vent hole located downstream of said manually operable valve;

a normally open check valve mounted at said vent hole for opening upon closure of said manually operable valve in order to vent said outlet tube and permit water to drain from said outlet tube;

a hose distally connected to said dispensing device and adapted to be proximally connected to a supply line for a toilet in order to supply water to said dispensing device; and a cleaning agent loaded into said dispensing device for progressive dissolution into water passing through said dispensing device.

15. A toilet cleaning device according to claim 14 wherein said cleaning agent comprises a plurality of solid pellets having a disinfecting action.

16. A toilet cleaning device according to claim 14 wherein said dispensing device comprises:

a barrel section having a barrel cavity adapted to hold said cleaning agent; and a nosepiece removably attached to said barrel to contain said cleaning agent.

17. A toilet cleaning device according to claim 14 wherein said dispensing device has a barrel section, said outlet tube being cantilevered, elongated and supported by said barrel, said outlet tube dispensing all water flowing therethrough in a single concentrated stream.

18. A toilet cleaning device according to claim 17 wherein said outlet tube has a proximal section and a distal section disposed at an oblique angle from said proximal section.

19. A toilet cleaning device according to claim 18 wherein said barrel section has a barrel cavity, said cleaning agent being loaded in said barrel cavity, said dispensing device having a nosepiece removably attached to said barrel to contain said cleaning agent.

20. A toilet cleaning device comprising:

a handheld dispensing device having a handle section and a barrel section with a barrel cavity, said dispensing device having an internal barrier with a channel and an orifice, said barrier being arranged to compel water passing through said dispensing device to flow through said orifice in said barrier, said dispensing device including:

(a) a manually operable valve with an external trigger and a shuttle that is coupled to said trigger and slidably mounted in said channel to control water flow through said orifice, said dispensing device having a vent hole located downstream of said manually operable valve, (b) a cleaning agent in the form of a plurality of solid, water soluble pellets loaded in said barrel cavity, (c) a nosepiece removably attached to said barrel to contain said cleaning agent, (d) an elongated outlet tube cantilevered from said nosepiece, said outlet tube having a proximal section and a distal section disposed at an oblique angle from said proximal section, said outlet tube being arranged to dispense all water flowing therethrough in a single concentrated stream into said toilet, and (e) a normally open check valve located at said vent hole for opening upon closure of said manually operable valve to permit water to drain from said outlet tube;

a hose distally connected to said dispensing device and adapted to be proximally connected to a supply line for a toilet in order to supply water to said dispensing device; and a holster for holding said dispensing device, said holster being adapted for mounting at said toilet.

* * * * *